US011236767B2

(12) United States Patent
Ikeda et al.

(10) Patent No.: US 11,236,767 B2
(45) Date of Patent: Feb. 1, 2022

(54) ELECTRIC BLOWER, ELECTRIC VACUUM CLEANER AND HAND DRYER

(71) Applicants: Mitsubishi Electric Corporation, Tokyo (JP); Mitsubishi Electric Home Appliance Co., Ltd., Fukaya (JP)

(72) Inventors: Takashi Ikeda, Tokyo (JP); Naho Adachi, Tokyo (JP); Mitsumasa Hamazaki, Fukaya (JP); Masaya Teramoto, Fukaya (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 477 days.

(21) Appl. No.: 16/331,609

(22) PCT Filed: Oct. 7, 2016

(86) PCT No.: PCT/JP2016/079999
§ 371 (c)(1),
(2) Date: Mar. 8, 2019

(87) PCT Pub. No.: WO2018/066134
PCT Pub. Date: Apr. 12, 2018

(65) Prior Publication Data
US 2019/0219066 A1 Jul. 18, 2019

(51) Int. Cl.
*F04D 29/58* (2006.01)
*A47K 10/48* (2006.01)
(Continued)

(52) U.S. Cl.
CPC ..... *F04D 29/5806* (2013.01); *A47K 10/48* (2013.01); *A47L 5/22* (2013.01);
(Continued)

(58) Field of Classification Search
CPC ..... F04D 29/5806; F04D 29/58; F04D 17/10; F04D 29/584; F04D 29/281;
(Continued)

(56) References Cited

U.S. PATENT DOCUMENTS

2008/0104837 A1 5/2008 Ikeda et al.
2013/0302156 A1 11/2013 Nurzynski

FOREIGN PATENT DOCUMENTS

JP H07-063193 A 3/1995
JP 2003-180554 A 7/2003
(Continued)

OTHER PUBLICATIONS

International Search Report of the International Searching Authority dated Dec. 20, 2016 for the corresponding International application No. PCT/JP2016/079999 (and English translation).
(Continued)

*Primary Examiner* — David Redding
(74) *Attorney, Agent, or Firm* — Posz Law Group, PLC

(57) ABSTRACT

An electric blower includes: an electric motor portion including a rotation shaft; a centrifugal impeller; and a heat dissipating portion connecting the centrifugal impeller and the rotation shaft. A boss portion of the centrifugal impeller is provided with a first hole extending in an extending direction of the rotation shaft. The heat dissipating portion includes a first portion connected to an inner circumferential surface of the first hole, and a second portion connected to the first portion in the extending direction and located outside the first hole. A length of the heat dissipating portion in the extending direction is longer than a length of the first hole in the extending direction.

10 Claims, 7 Drawing Sheets

(51) Int. Cl.

| | |
|---|---|
| ***A47L 5/22*** | (2006.01) |
| ***A47L 9/00*** | (2006.01) |
| ***F04D 17/10*** | (2006.01) |

(52) U.S. Cl.
CPC ..... *A47L 9/00* (2013.01); *F04D 17/10* (2013.01); *F04D 29/58* (2013.01); *F04D 29/584* (2013.01); *F05D 2260/221* (2013.01)

(58) Field of Classification Search
CPC ..... F04D 29/5853; F04D 29/263; A47L 9/00; A47L 5/22; A47L 9/22; A47K 10/48; F05D 2260/221
See application file for complete search history.

(56) References Cited

FOREIGN PATENT DOCUMENTS

| | | | |
|---|---|---|---|
| JP | 2006-299634 | A | 11/2006 |
| JP | 2007-009714 | A | 1/2007 |
| JP | 2008-115759 | A | 5/2008 |
| JP | 2013-032712 | A | 2/2013 |
| JP | 2014-501873 | A | 1/2014 |
| JP | 2014-034935 | A | 2/2014 |
| WO | 2012/072996 | A1 | 6/2012 |

OTHER PUBLICATIONS

Office Action dated Mar. 31, 2020 issued in corresponding JP patent application No. 2018-543564 (and English translation).

ELECTRIC BLOWER, ELECTRIC VACUUM CLEANER AND HAND DRYER

CROSS REFERENCE TO RELATED APPLICATION

This application is a U.S. national stage application of International Application PCT/JP2016/079999, filed on Oct. 7, 2016, the contents of which are incorporated herein by reference.

TECHNICAL FIELD

The present invention relates to an electric blower, an electric vacuum cleaner and a hand dryer.

BACKGROUND

Conventionally, a centrifugal electric blower used in an electric vacuum cleaner and a hand dryer has been known. For example, Japanese National Patent Publication No. 2014-501873 (PTL 1) discloses a blower in which a hub made of a plastic material is coupled to a shaft of a motor.

In addition, Japanese Patent Application No. 2006-299634 (Japanese Laid-Open Application No. 2008-115759) (PTL 2) discloses an impeller in which a bush made of a metal is inserted into an impeller main body made of a synthetic resin.

PATENT LITERATURE

PTL 1: Japanese National Patent Publication No. 2014-501873

PTL 2: Japanese Patent Application No. 2006-299634 (Japanese Laid-Open Application No. 2008-115759)

A centrifugal electric blower is higher in static pressure and lower in air volume than an axial blower used in an air conditioner and the like. Therefore, as compared with the axial electric blower, the conventional centrifugal electric blower has difficulty in efficiently dissipating heat generated at an electric motor portion to the air flowing through an air path.

The blower described in PTL 1 above has a problem of being unable to effectively dissipate heat transmitted from the motor of an electric motor portion to the rotation shaft (shaft). In the impeller described in PTL 2 above, only a surface of the bush located on the front side is exposed to the outside (air path). Therefore, a part of the heat transmitted from a shaft to the bush is transmitted from the above-described exposed surface of the bush to the air flowing through the air path, whereas most of the heat transmitted from the shaft to the bush is transmitted to the impeller main body. Thus, the impeller described in PTL 2 above also has a problem of being unable to effectively dissipate the heat transmitted from the motor to the shaft.

SUMMARY

The present invention has been made to solve the above-described problem. A main object of the present invention is to provide an electric blower capable of effectively dissipating heat transmitted to a rotation shaft, an electric vacuum cleaner having the electric blower mounted thereon, and a hand dryer having the electric blower mounted thereon.

An electric blower according to the present invention includes: an electric motor portion including a rotation shaft;

a centrifugal impeller formed to surround at least a part of the rotation shaft; and a heat dissipating portion connecting the centrifugal impeller and the rotation shaft. The centrifugal impeller includes a boss portion connected to the heat dissipating portion, and a plurality of rotors connected to the boss portion. The boss portion is provided with a first hole extending along an extending direction of the rotation shaft. The heat dissipating portion includes a first portion connected to an inner circumferential surface of the first hole, and at least one second portion connected to the first portion in the extending direction and located outside the first hole. A material for the heat dissipating portion has a thermal conductivity higher than that of a material for the centrifugal impeller. A length of the heat dissipating portion in the extending direction is longer than a length of the first hole in the extending direction.

In the electric blower according to the present invention, the centrifugal impeller is connected to the rotation shaft of the electric motor portion with the heat dissipating portion being interposed, and a distance of the heat dissipating portion in the above-described extending direction is longer than a distance of the centrifugal impeller in the above-described extending direction. That is, the heat dissipating portion has an exposed surface larger than that of a conventional bush. Therefore, the heat transmitted to the rotation shaft of the electric blower is effectively dissipated through the heat dissipating portion. According to the present invention, there can be obtained an electric blower capable of effectively dissipating heat transmitted from a motor to a shaft, an electric vacuum cleaner having the electric blower mounted thereon, and a hand dryer having the electric blower mounted thereon.

DETAILED DESCRIPTION

Figure 1:
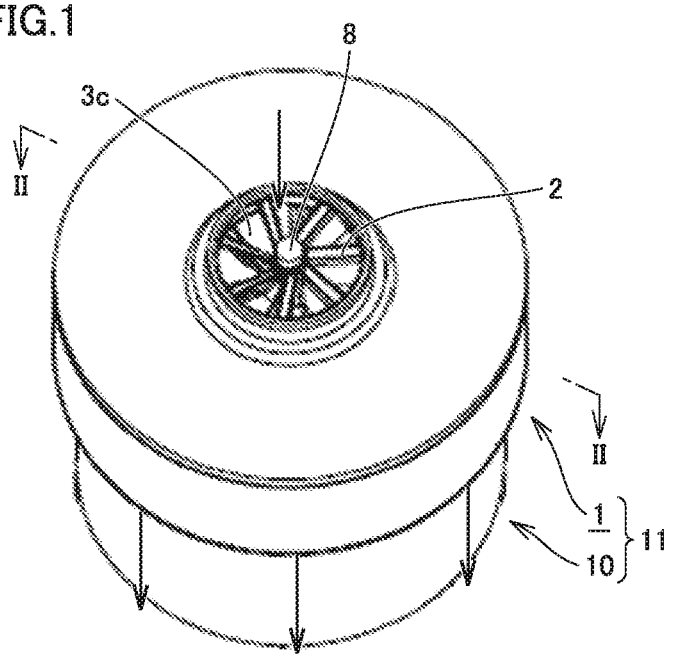
FIG. 1 is a perspective view showing an appearance of an electric blower according to a first embodiment.

Embodiments of the present invention will be described hereinafter with reference to the drawings, in which the same or corresponding portions are denoted by the same reference numerals and description thereof will not be repeated.

First Embodiment

<Configuration of Electric Blower>

An electric blower 11 according to a first embodiment will be described with reference to FIGS. 1 to 5. The arrows in FIGS. 1 and 2 indicate a part of an air flow AF in electric blower 11, by way of example. The arrows in FIG. 3 indicate a part of a flow of heat generated in an electric motor portion 10 in electric blower 11, by way of example.

Electric blower 11 mainly includes a centrifugal impeller 2, a heat dissipating portion 7, an inlet casing 3, a back casing 4, and electric motor portion 10. Centrifugal impeller 2 and heat dissipating portion 7 form a centrifugal impeller unit 1. Centrifugal impeller unit 1 is connected to a shaft 6 (rotation shaft) of electric motor portion 10 and is rotated by electric motor portion 10.

Figure 4:
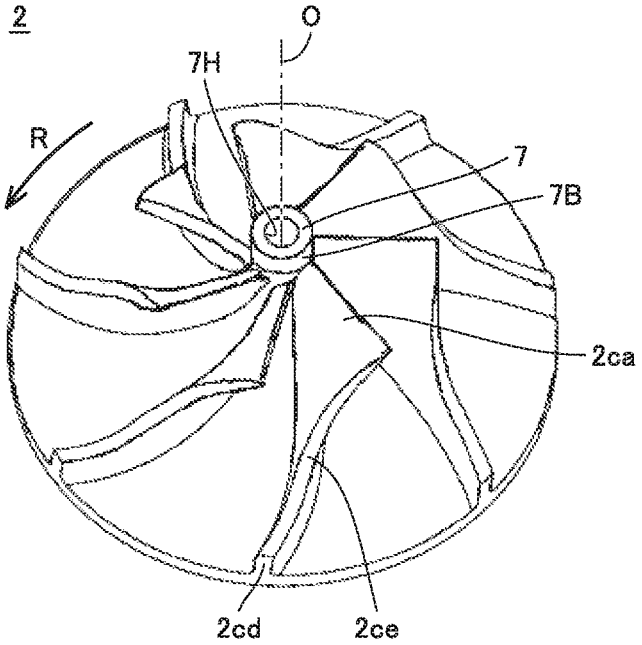
FIG. 4 is a perspective view showing the centrifugal impeller unit of the electric blower according to the first embodiment.
Figure 5:
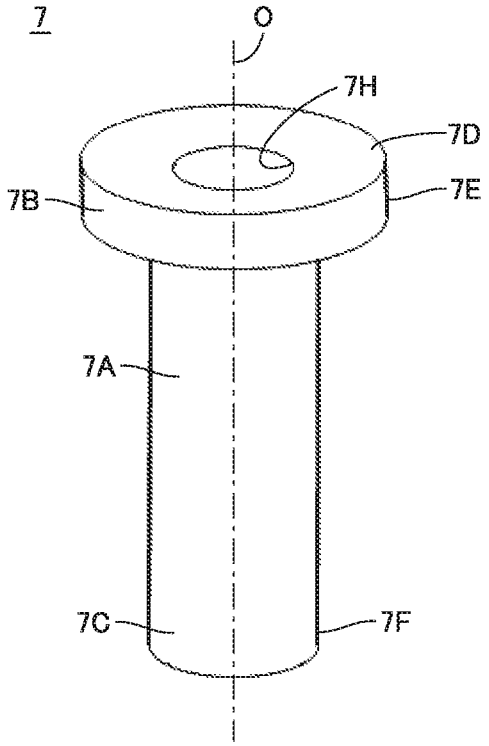
FIG. 5 is a perspective view showing a heat dissipating portion according to the first embodiment.

Hereinafter, a direction in which shaft 6 extends (direction in which a rotation center O indicated by an alternate long and short dash line in FIGS. 2 and 4 extends) will be simply referred to as "extending direction". Hereinafter, a radial direction that is perpendicular to the extending direction and extends from the center of shaft 6 toward the outer circumferential side will be simply referred to as "radial direction". Hereinafter, a suction side of electric blower 11 in the extending direction will be referred to as "front side", and a side opposite to the suction side will be referred to as "back side".

Centrifugal impeller 2 includes a boss portion 2*a* and a plurality of rotor vanes 2*c*. When viewed from the above-described extending direction, boss portion 2*a* has a planar shape having a circular outer shape. A central portion of boss portion 2*a* in the radial direction of boss portion 2*a* perpendicular to the above-described extending direction protrudes toward the front side, as compared with an outer circumferential portion of boss portion 2*a* located closer to an outer circumference than the central portion in the radial direction. The above-described central portion of boss portion 2*a* has an end of boss portion 2*a* located on the front side. The above-described outer circumferential portion of boss portion 2*a* has an end of boss portion 2*a* located on the back side. Boss portion 2*a* and the plurality of rotor vanes 2*c* of centrifugal impeller 2 are formed to surround a part of shaft 6.

A first hole 2H (see FIG. 3) extending along the above-described extending direction is formed in the above-described central portion of boss portion 2*a*. An inner circumferential surface of first hole 2H is connected to an outer circumferential surface of a first portion 7A of heat dissipating portion 7 described below. A hole axis of first hole 2H is along the above-described extending direction. First hole 2H is a through hole. A hole diameter of first hole 2H exceeds a width W3 (see FIG. 3) of shaft 6 in the above-described radial direction. The hole diameter of first hole 2H is not less than a width W2 (see FIG. 3) of first portion 7A of heat dissipating portion 7 in the above-described radial direction.

Figure 2:
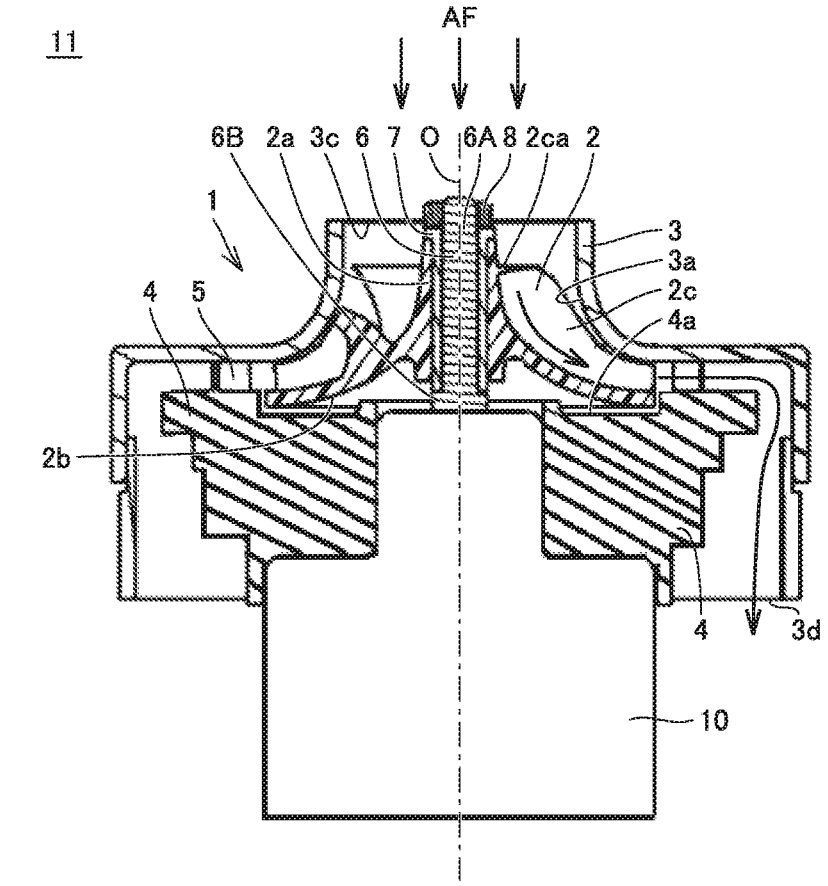
FIG. 2 is a cross-sectional view viewed from line II-II in FIG. 1.
Figure 3:
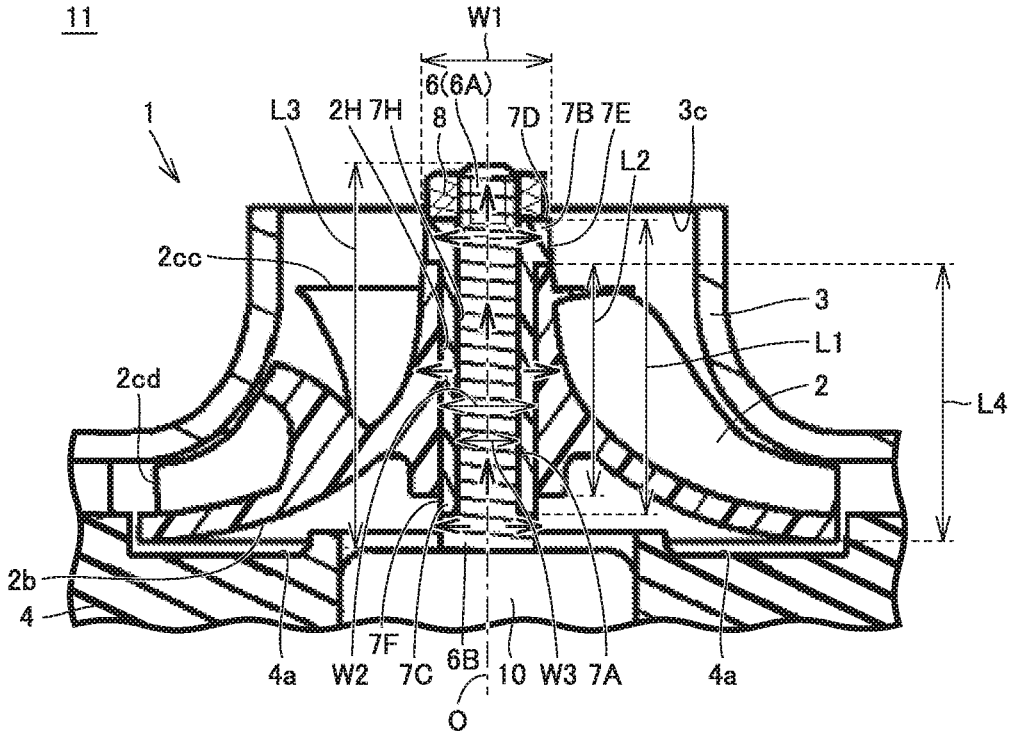
FIG. 3 is a partial cross-sectional view for illustrating a centrifugal impeller unit in FIG. 2.

As shown in FIGS. 2 and 3, in a cross section along the above-described extending direction, an outer circumferential surface of boss portion 2*a* is formed to be, for example, curved. Boss portion 2*a* is formed such that an angle formed by a tangent line of the curve with respect to the above-described extending direction becomes greater gradually from the front side toward the back side. In other words, boss portion 2*a* is formed such that a width of boss portion 2*a* in the above-described radial direction becomes greater gradually from the front side toward the back side in the above-described extending direction. The above-described width of boss portion 2*a* refers to a distance between portions facing each other with rotation center O (see FIG. 2) being interposed, of the surface (outer circumferential surface) of boss portion 2*a* located on the outer circumferential side in the above-described radial direction. A width of the end of boss portion 2*a* located on the front side in the above-described radial direction is smaller than a width of the end of boss portion 2*a* located on the back side in the above-described radial direction, and shows a minimum value of the width of boss portion 2*a* in the above-described radial direction. The width of the end of boss portion 2*a* located on the back side in the above-described radial direction shows a maximum value of the width of boss portion 2*a* in the above-described radial direction.

The plurality of rotor vanes 2*c* are connected to a portion of boss portion 2*a* located closer to the outer circumference than first hole 2H in the above-described radial direction. The plurality of rotor vanes 2*c* are spaced apart from one another in a circumferential direction perpendicular to the above-described extending direction. A first edge 2*cc* of each of the plurality of rotor vanes 2*c* located on the front side in the above-described extending direction and located on the center side in the above-described radial direction is inclined forward in a rotation direction R (see FIG. 4) of centrifugal impeller unit 1. A second edge 2*cd* of each of the plurality of rotor vanes 2*c* located on the front side in the above-described extending direction and located on the outer circumferential side in the above-described radial direction is inclined backward in rotation direction R (see FIG. 4) of centrifugal impeller unit 1. As shown in FIG. 4, each of the plurality of rotor vanes 2*c* is formed such that first edge 2*cc*, second edge 2*cd*, and a third edge 2*ce* located between first edge 2*cc* and second edge 2*cd* form an S shape when viewed from the above-described extending direction. The plurality of rotor vanes 2*c* are formed such that a thickness of the plurality of rotor vanes 2*c* in the circumferential direction perpendicular to the above-described extending direction becomes smaller gradually in the above-described radial direction.

A material for centrifugal impeller 2 may be an arbitrary material and is, for example, a resin material. Boss portion 2*a* and the plurality of rotor vanes 2*c* of centrifugal impeller 2 are integrally formed, for example. The material for centrifugal impeller 2 is, for example, lower in thermal conductivity than a material for shaft 6 of electric motor portion 10.

Heat dissipating portion 7 includes first portion 7A located inside first hole 2H of centrifugal impeller 2, and second portions 7B and 7C located outside first hole 2H. Second portions 7B and 7C are connected to first portion 7A in the above-described extending direction. Second portion 7B is formed on the front side of first portion 7A. Second portion 7C is formed on the back side of first portion 7A. Second portions 7B and 7C are formed to sandwich first portion 7A in the above-described extending direction.

As shown in FIG. 3, a length L1 of heat dissipating portion 7 in the above-described extending direction is longer than a length L2 of first hole 2H in the above-described extending direction. Length L2 of first hole 2H in the above-described extending direction is equal to a length of the above-described central portion of boss portion 2*a* in the above-described extending direction. Length L1 of heat dissipating portion 7 in the above-described extending direction is, for example, less than a length L3 of shaft 6 of electric motor portion 10 in the above-described extending direction. Preferably, above-described length L1 of heat dissipating portion 7 is longer than a length L4 of centrifugal impeller 2 in the above-described extending direction. Length L4 of centrifugal impeller 2 in the above-described extending direction refers to, for example, a distance in the above-described extending direction between the end of boss portion 2*a* located on the front side and the end of boss portion 2*a* located on the back side. Preferably, a length of second portion 7B in the above-described extending direction is longer than a length of second portion 7C in the above-described extending direction.

As shown in FIG. 3, width W2 of first portion 7A in the above-described radial direction is not more than the hole diameter of first hole 2H. Width W1 of second portion 7B in the above-described radial direction exceeds above-described width W2 of first portion 7A. Above-described width W1 of second portion 7B exceeds the hole diameter of first hole 2H. From a different perspective, second portion 7B protrudes in the above-described radial direction from first portion 7A. A width of second portion 7C in the above-described radial direction is, for example, equal to above-described width W2 of first portion 7A. Above-described width W2 of first portion 7A refers to a distance between portions facing each other with rotation center O being interposed, of the outer circumferential surface of first portion 7A located on the outer circumferential side in the above-described radial direction. Above-described width W1 of second portion 7B refers to a distance between portions facing each other with rotation center O being interposed, of an outer circumferential surface of second portion 7B located on the outer circumferential side in the above-described radial direction. The above-described width of second portion 7C refers to a distance between portions facing each other with rotation center O being interposed, of an outer circumferential surface of second portion 7C located on the outer circumferential side in the above-described radial direction.

As shown in FIG. 3, each of second portions 7B and 7C of heat dissipating portion 7 has a surface exposed to the outside in centrifugal impeller unit 1. Second portion 7B has, for example, a first exposed surface 7D extending along the above-described radial direction, and a second exposed surface 7E extending along the above-described extending direction. First exposed surface 7D is a surface located on the front side of second portion 7B. Second exposed surface 7E is a side surface of second portion 7B connected to an outer circumferential end of the surface located on the front side of second portion 7B and extending along the above-described circumferential direction. Preferably, second exposed surface 7E and the outer circumferential surface (exposed surface) of boss portion 2*a* located on the outer circumferential side in the above-described radial direction are connected to form the same plane. In other words, preferably, a difference in level is not formed between second exposed surface 7E and the outer circumferential surface of boss portion 2*a* located on the outer circumferential side in the above-described radial direction. Second portion 7C has, for example, a third exposed surface 7F extending along the above-described extending direction.

In centrifugal impeller unit 1, second exposed surface 7E and a portion of first exposed surface 7D that is not in contact with a fixing member 8 described below form a surface exposed to a below-described first air path in electric blower 11. In centrifugal impeller unit 1, third exposed surface 7F forms a surface exposed to a below-described second air path in electric blower 11.

Centrifugal impeller 2 and heat dissipating portion 7 may be fixed by an arbitrary method, and are fixed by, for example, an adhesive. In this case, the adhesive is not subjected to deterioration and the like even when the adhesive is heated to a temperature of centrifugal impeller 2 and heat dissipating portion 7 that can be reached during operation of electric blower 11.

A second hole 7H extending along the extending direction is formed in heat dissipating portion 7. An inner circumferential surface of second hole 7H is connected to a part of an outer circumferential surface of shaft 6. A hole axis of second hole 7H is along the hole axis of first hole 2H and the above-described extending direction. Second hole 7H is a through hole. Second hole 7H is formed to extend from a surface of second portion 7B located on the front side to a surface of second portion 7C located on the back side. Each of first portion 7A and second portions 7B and 7C has, for example, a cylindrical shape.

A material for heat dissipating portion 7 is higher in thermal conductivity than the material for centrifugal impeller 2. The material for heat dissipating portion 7 is, for example, a metal, and is, for example, aluminum (Al). First portion 7A and second portions 7B and 7C are integrally formed, for example.

Inlet casing 3 is formed to include at least a part of boss portion 2*a*, the plurality of rotor vanes 2*c*, a plurality of stator vanes 5 described below, and back casing 4. An inner surface 3*a* of inlet casing 3 located on the inner side faces the first air path described below. Inner surface 3*a* located on the front side in the above-described extending direction is spaced apart from above-described second exposed surface 7E of second portion 7B of heat dissipating portion 7 and the outer circumferential surface of boss portion 2*a* in the above-described radial direction. Inner surface 3*a* of inlet casing 3 located on the outer circumferential side in the above-described radial direction is spaced apart from an outer surface 4*a* of back casing 4 located on the outer side. Outer surface 4*a* of back casing 4 faces the first air path described below.

A suction port 3*c* located on the front side of the plurality of rotor vanes 2*c* is formed in inlet casing 3. When viewed from the above-described extending direction, suction port 3*c* has, for example, a circular planar shape. A diameter of suction port 3*c* is smaller than, for example, a maximum value of the width of boss portion 2*a* in the above-described radial direction (width of the end of boss portion 2*a* located on the back side in the above-described radial direction).

Back casing 4 has surface 4*a* located on the front side in the above-described extending direction. Surface 4*a* of back casing 4 is arranged to face, in the above-described extending direction, a surface 2*b* located on the back side of boss portion 2*a* of centrifugal impeller 2. Back casing 4 is formed to surround, for example, a part of electric motor portion 10 located on the front side in the above-described circumferential direction. A discharge port 3*d* located on the back side of the plurality of rotor vanes 2*c* and the plurality of stator vanes 5 in the above-described extending direction and located closer to the outer circumference than the plurality of rotor vanes 2*c* in the above-described radial direction is formed between inlet casing 3 and back casing 4. When viewed from the above-described extending direction, discharge port 3*d* has, for example, an annular planar shape.

The plurality of stator vanes 5 are formed between the inner surface of inlet casing 3 and the outer surface of back casing 4. Each of the plurality of stator vanes 5 is formed closer to the outer circumference than the plurality of rotor vanes 2*c* in the above-described radial direction.

Electric motor portion 10 includes shaft 6 serving as a rotation shaft, and a motor (not shown) configured to rotate shaft 6. Shaft 6 is arranged on the front side of the motor. An end of shaft 6 located on the front side is located on the front side of suction port 3*c* of inlet casing 3, for example. The entire inner circumferential surface of second hole 7H of heat dissipating portion 7 is in contact with the outer circumferential surface of shaft 6. Length L3 of shaft 6 in the above-described extending direction is, for example, longer than length L1 of heat dissipating portion 7 in the above-described extending direction. A back portion 6B located on the back side in shaft 6 protrudes toward the outer circumferential side in the above-described radial direction from a front portion 6A located on the front side in shaft 6. The motor may have an arbitrary configuration, and is, for example, an AC motor that is a commutator motor.

A surface of back portion 6B located on the front side is in contact with a surface of second portion 7C of heat dissipating portion 7 located on the back side. As a result, positional displacement of heat dissipating portion 7 toward the back side is suppressed by back portion 6B of shaft 6. An outer circumferential surface of back portion 6B located on the outer circumferential side in the above-described radial direction is exposed to the second air path described below.

Fixing member 8 is fixed to an area of front portion 6A of shaft 6 located on the front side of second portion 7B of heat dissipating portion 7. The area of front portion 6A located on the front side of second portion 7B of heat dissipating portion 7 and fixing member 8 are provided to be capable of being tightened, for example. As a result, positional displacement of heat dissipating portion 7 toward the front side is suppressed by fixing member 8. That is, shaft 6 and heat dissipating portion 7 are positioned in the above-described extending direction by back portion 6B of shaft 6 and fixing member 8. A half of a difference between a width of back portion 6B in the above-described radial direction and a width of front portion 6A in the above-described radial direction is, for example, equal to a thickness of second portion 7C of heat dissipating portion 7 in the above-described radial direction.

<Operation of Electric Blower>

As shown in FIG. 2, electric blower 11 is configured such that when electric power is supplied to electric motor portion 10, shaft 6 rotates. When shaft 6 rotates, centrifugal impeller 2 attached to shaft 6 rotates, to thereby suck air through suction port 3*c*. The air sucked into electric blower 11 by centrifugal impeller 2 is pressurized and accelerated by centrifugal impeller 2, and is directed radially outward while swirling. The air discharged from centrifugal impeller 2 is decelerated and pressurized between the plurality of stator vanes 5. Thereafter, the air is exhausted through discharge port 3*d* to the outside of electric blower 11. The rotation speed of centrifugal impeller 2 is, for example, not less than 30000 rpm and not more than 150000 rpm.

As a result, the first air path extending from suction port 3*c* through regions between the plurality of rotor vanes 2*c* and regions between the plurality of stator vanes 5 to discharge port 3*d* is formed in electric blower 11. Furthermore, the second air path is formed in a space of electric blower 11 located on the back side of boss portion 2*a* of centrifugal impeller 2 and formed between surface 2*b* located on the back side of boss portion 2*a* and surface 4*a* of back casing 4. The air in the second air path mainly whirls and flows around shaft 6. The first air path and the second air path are connected to allow the air to flow therein and thereout.

As shown in FIG. 3, during the above-described operation of electric blower 11, most of the heat transmitted from the motor of electric motor portion 10 to shaft 6 is transmitted to heat dissipating portion 7. A part of the heat transmitted to heat dissipating portion 7 is transmitted through first exposed surface 7D and second exposed surface 7E of second portion 7B of heat dissipating portion 7 to the air flowing through the first air path. Another part of the heat transmitted to heat dissipating portion 7 is transmitted through third exposed surface 7F of second portion 7C of heat dissipating portion 7 to the air flowing through the second air path. Still another part of the heat transmitted to heat dissipating portion 7 is transmitted through first portion 7A and second portion 7B to centrifugal impeller 2. The heat transmitted to centrifugal impeller 2 is transmitted through the outer circumferential surface of boss portion 2*a* or the surfaces of the plurality of rotor vanes 2*c* to the air flowing through the first air path or the second air path.

Another part of the heat transmitted to shaft 6 is transmitted through fixing member 8 to the air flowing through the first air path. Still another part of the heat transmitted to shaft 6 is transmitted through back portion 6B to the air flowing through the second air path.

<Function and Effect of Electric Blower>

As shown in FIGS. 1 to 5, in electric blower 11, shaft 6 of electric motor portion 10 and boss portion 2*a* of centrifugal impeller 2 are connected with heat dissipating portion 7 being interposed. The material for heat dissipating portion 7 is higher in thermal conductivity than the material for centrifugal impeller 2. Furthermore, length L1 of heat dissipating portion 7 in the above-described extending direction is longer than length L2 of centrifugal impeller 2 in the above-described extending direction. Therefore, heat dissipating portion 7 has an exposed surface larger than that of the above-described bush in the conventional blower. As a result, the heat transmitted from the motor of electric motor portion 10 to shaft 6 is quickly transmitted to heat dissipating portion 7 as a whole. The heat transmitted to second portion 7B is transmitted through first exposed surface 7D and second exposed surface 7E to the air flowing through the first air path. As a result, electric blower 11 can effectively dissipate the heat transmitted from shaft 6 to heat dissipating portion 7. Therefore, heating and deformation of centrifugal impeller 2 by the heat of electric motor portion 10 are suppressed. As a result, electric blower 11 has high reliability.

In addition, as described above, the conventional centrifugal impeller may be heated to a relatively high temperature. Therefore, a material for the conventional centrifugal impeller is limited to a material having a high heat resistance in order to suppress deformation and the like of the centrifugal impeller by heat. In contrast, a temperature of centrifugal impeller 2 when electric blower 11 is operated under prescribed conditions is lower than a temperature of the centrifugal impeller when the conventional electric blower is operated under the conditions. Therefore, the material for centrifugal impeller 2 may be a material having a heat resistance lower than that of the material for the conventional centrifugal impeller. With such a configuration as well, deformation of centrifugal impeller 2 is suppressed.

In above-described electric blower 11, first hole 2H is a hole penetrating through boss portion 2*a*. Heat dissipating portion 7 includes second portion 7B formed on the suction side of electric blower 11 with respect to first hole 2H. That is, heat dissipating portion 7 includes second portion 7B facing the first air path in electric blower 11. A flow volume and a flow velocity of the air flowing through the first air path are higher than a flow volume and a flow velocity of the air flowing through the second air path. Therefore, electric blower 11 provided with such heat dissipating portion 7 has a heat dissipation property higher than that of electric blower 11 provided with heat dissipating portion 7 including only second portion 7C that faces the second air path.

In above-described electric blower 11, maximum value W1 of the width of second portion 7B in the above-described radial direction is not more than the minimum value of the width of boss portion 2*a* in the above-described radial direction. Such second portion 7B does not protrude toward the outer circumferential side from the outer circumferential surface of boss portion 2*a* in the above-described radial direction. Such second portion 7B does not inhibit the flow of the air in the first air path. Therefore, electric blower 11 can effectively and efficiently dissipate the heat transmitted from shaft 6 to heat dissipating portion 7.

In above-described electric blower 11, heat dissipating portion 7 further includes second portion 7C formed on the side opposite to the suction side of electric blower 11 with respect to first hole 2H. With such a configuration, second portion 7C faces the second air path, and thus, the heat transmitted from shaft 6 to heat dissipating portion 7 can be transmitted to the air flowing through the second air path. As a result, such electric blower 11 can more effectively dissipate the heat transmitted from shaft 6 to heat dissipating portion 7.

In above-described electric blower 11, maximum value W1 of an outer diameter of second portions 7B and 7C in the above-described radial direction is larger than maximum value W2 of an outer diameter of first portion 7A in the above-described radial direction. With such a configuration, the surface area of second portions 7B and 7C can be increased, as compared with the case in which maximum value W1 of the outer diameter of second portions 7B and 7C is equal to maximum value W2 of the outer diameter of first portion 7A. As a result, such electric blower 11 can more effectively dissipate the heat transmitted from shaft 6 to heat dissipating portion 7.

In above-described electric blower 11, the material for heat dissipating portion 7 is a metal, and the material for centrifugal impeller 2 is a resin. With such a configuration, centrifugal impeller unit 1 formed of centrifugal impeller 2 and heat dissipating portion 7 can be easily manufactured by, for example, insert molding using a die. Specifically, centrifugal impeller unit 1 formed of integrally molded heat dissipating portion 7 and centrifugal impeller 2 can be manufactured by inserting heat dissipating portion 7 into the die and injecting a resin into an area around heat dissipating portion 7. As a result, electric blower 11 can be easily manufactured.

Above-described centrifugal impeller unit 1 includes centrifugal impeller 2 and heat dissipating portion 7. Centrifugal impeller 2 includes boss portion 2*a* provided with first hole 2H extending along the above-described extending direction (first direction), and the plurality of rotor vanes 2*c* connected to boss portion 2*a*. Heat dissipating portion 7 includes first portion 7A located inside first hole 2H, and second portions 7B and 7C connected to first portion 7A in the above-described extending direction (first direction) and located outside the first hole (2H). First portion 7A is connected to boss portion 2*a*. Second hole 7H is formed in first portion 7A. The material for heat dissipating portion 7 has a thermal conductivity higher than that of the material for centrifugal impeller 2. Length L1 of heat dissipating portion 7 in the above-described extending direction (first direction) is longer than the length of first hole 2H in the above-described extending direction (first direction). Shaft 6 of electric motor portion 10 is inserted into and fixed to second hole 7H, and thus, such centrifugal impeller unit 1 can form above-described electric blower 11. Electric motor portion 10 may be configured similarly to the conventional electric motor portion. Centrifugal impeller unit 1 includes above-described heat dissipating portion 7, and thus, centrifugal impeller unit 1 can effectively dissipate the heat transmitted from shaft 6 to heat dissipating portion 7.

Second Embodiment

Figure 6:
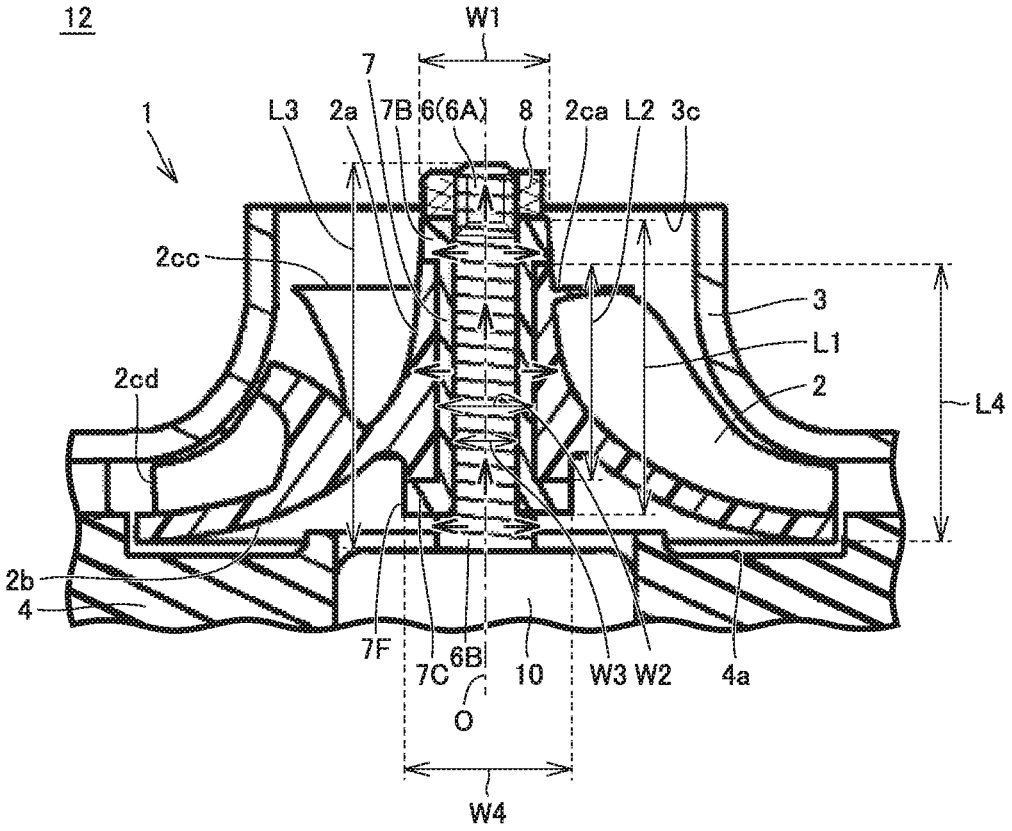
FIG. 6 is a partial cross-sectional view showing a centrifugal impeller unit of an electric blower according to a second embodiment.

Next, an electric blower 12 according to a second embodiment will be described with reference to FIG. 6. Basically, electric blower 12 is configured similarly to electric blower 11 according to the first embodiment. However, electric blower 12 according to the second embodiment is different from electric blower 11 according to the first embodiment in that a maximum value W4 of the width of second portion 7C of heat dissipating portion 7 in the above-described radial direction is larger than maximum value W2 of the width of first portion 7A in the above-described radial direction.

Maximum value W4 of the above-described width of second portion 7C of heat dissipating portion 7 is larger than a maximum value of the width of back portion 6B of shaft 6 in the above-described radial direction. Maximum value W4 of the above-described width of second portion 7C is, for example, larger than maximum value W1 of the above-described width of second portion 7B. A surface of second portion 7C located on the back side is exposed to the second air path.

With such a configuration, as compared with electric blower 11, electric blower 12 can more effectively dissipate the heat from second portion 7C of heat dissipating portion 7 to the air flowing through the second air path. In addition, such heat dissipating portion 7 and centrifugal impeller 2 can be easily manufactured by insert molding as described above. Furthermore, the occurrence of positional displacement in the above-described radial direction is more effectively suppressed in centrifugal impeller 2 and heat dissipating portion 7 of electric blower 12 than in centrifugal impeller 2 and heat dissipating portion 7 of electric blower 11.

Maximum value W4 of the outer diameter of second portion 7C may be, for example, not more than maximum value W1 of the outer diameter of second portion 7B. With such a configuration as well, the effect similar to that of above-described electric blower 12 can be produced.

Third Embodiment

Figure 7:
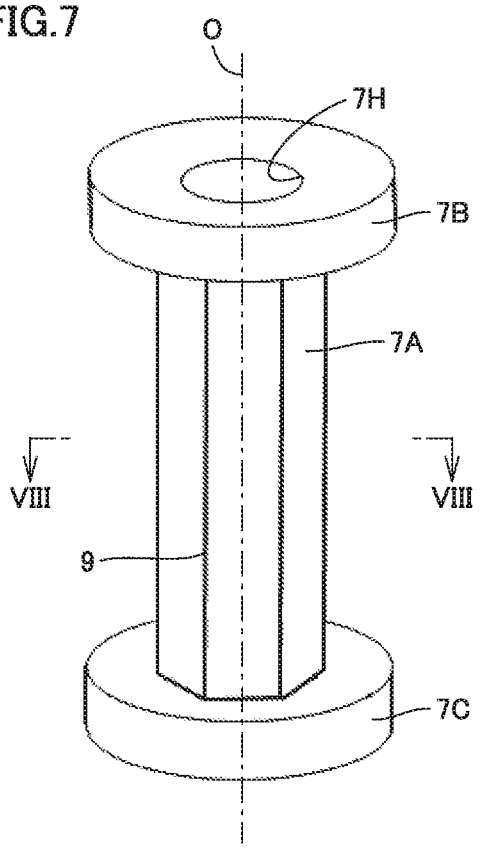
FIG. 7 is a perspective view showing a heat dissipating portion of an electric blower according to a third embodiment.
Figure 8:
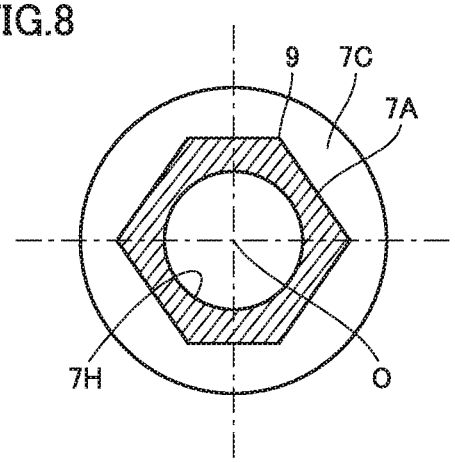
FIG. 8 is a cross-sectional view viewed from line VIII-VIII in FIG. 7.

Next, an electric blower according to a third embodiment will be described with reference to FIGS. 7 and 8. Basically, the electric blower according to the third embodiment is configured similarly to the electric blower according to the first embodiment. However, the electric blower according to the third embodiment is different from the electric blower according to the first embodiment in that the width of first portion 7A of heat dissipating portion 7 in the above-described radial direction varies in the above-described rotation direction. FIGS. 7 and 8 are perspective views showing only heat dissipating portion 7 according to the third embodiment, and do not show the other components of the electric blower.

As shown in FIGS. 7 and 8, in a cross section perpendicular to the above-described extending direction, an outer circumferential surface of first portion 7A of heat dissipating portion 7 is formed to have, for example, a regular hexagonal shape. Six corner portions 9 extending in the above-described extending direction are formed on the outer circumferential surface of first portion 7A. Thus, the width of first portion 7A of heat dissipating portion 7 in the above-described radial direction varies in the above-described rotation direction. A maximum value of the above-described width of first portion 7A of heat dissipating portion 7 is equal to a distance between two corner portions 9 facing each other in the above-described radial direction with rotation center O being interposed.

Preferably, the entire outer circumferential surface of first portion 7A is connected to boss portion 2*a* (see FIG. 2). In the above-described cross section, the inner circumferential surface (see FIG. 2) of first hole 2H formed in centrifugal impeller 2 is formed to have a regular hexagonal shape.

The area of the outer circumferential surface is larger in first portion 7A according to the third embodiment than in first portion 7A (see FIG. 5) according to the first embodiment in which the width of first portion 7A in the above-described radial direction is equal in the above-described rotation direction. That is, the contact area with the inner circumferential surface of first hole 2H of centrifugal impeller 2 is larger in first portion 7A according to the third embodiment than in first portion 7A according to the first embodiment. Therefore, the heat transmitted from shaft 6 to heat dissipating portion 7 is more effectively transmitted to centrifugal impeller 2 through first portion 7A in the electric blower according to the third embodiment than in electric blower 11. Furthermore, in the electric blower according to the third embodiment, the centrifugal impeller and heat dissipating portion 7 are likely to maintain a normally connected state even during high rotation. Therefore, the electric blower according to the third embodiment has high reliability.

Figure 9:
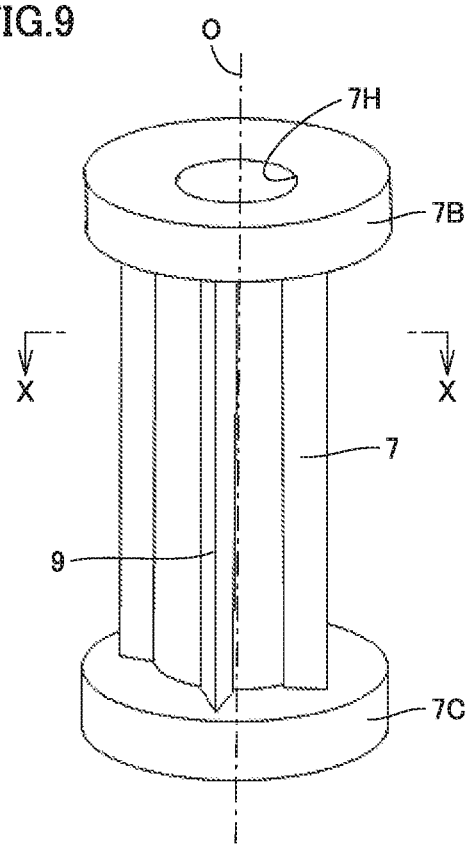
FIG. 9 is a perspective view showing a modification of the heat dissipating portion of the electric blower according to the third embodiment.
Figure 10:
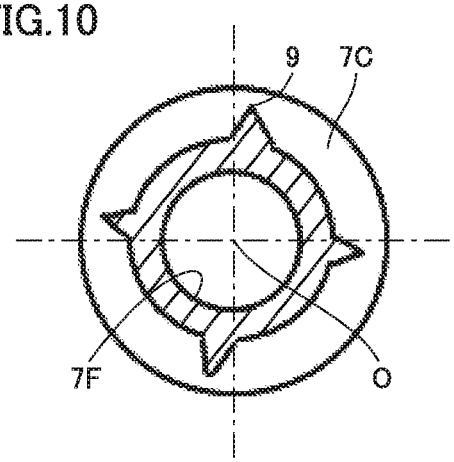
FIG. 10 is a cross-sectional view viewed from line X-X in FIG. 9.

Heat dissipating portion 7 of the electric blower according to the third embodiment is not limited to the configuration shown in FIGS. 7 and 8. As shown in FIGS. 9 and 10, in the cross section perpendicular to the above-described extending direction, the outer circumferential surface of first portion 7A of heat dissipating portion 7 has a portion formed to have an arc shape centered at rotation center O, and a portion protruding toward the outer circumferential side from the portion in the above-described radial direction. The outer circumferential surface of first portion 7A of heat dissipating portion 7 may be formed to have, for example, a dodecagonal shape. Four corner portions 9 extending in the above-described extending direction are, for example, formed on the outer circumferential surface of first portion 7A.

Preferably, the entire outer circumferential surface of first portion 7A is connected to boss portion 2*a* (see FIG. 2). Preferably, in the above-described cross section, four recesses (not shown) formed to be fittable to above-described corner portions 9 and extending in the above-described extending direction are formed in the inner circumferential surface of first hole 2H.

The electric blower according to the third embodiment including heat dissipating portion 7 shown in FIGS. 9 and 10 can also produce the effect similar to that of the electric blower according to the third embodiment including heat dissipating portion 7 shown in FIGS. 7 and 8.

In the cross section perpendicular to the above-described extending direction, the inner circumferential surface of second hole 7H may be formed to have an arbitrary shape, and is formed to have, for example, a circular shape.

Although heat dissipating portion 7 in each of electric blowers 11 and 12 according to the first to third embodiments described above includes second portions 7B and 7C exposed to the first air path or the second air path, heat dissipating portion 7 may include only at least one of second portions 7B and 7C. Heat dissipating portion 7 may include only second portion 7C. Preferably, heat dissipating portion 7 includes at least second portion 7B. More preferably, heat dissipating portion 7 includes second portion 7B and second portion 7C. An air volume of the first air path is larger than an air volume of the second air path. Therefore, heat dissipating portion 7 including second portion 7B can more effectively dissipate the heat than heat dissipating portion 7 including only second portion 7C and not including second portion 7B.

In addition, although maximum value W1 of the width of second portion 7B in the above-described radial direction is larger than maximum value W2 of the width of first portion 7A in the above-described radial direction in electric blowers 11 and 12 according to the first to third embodiments described above, the present invention is not limited thereto. Maximum value W1 of the above-described width of second portion 7B may be not less than maximum value W2 of the above-described width of first portion 7A. Above-described length L1 of heat dissipating portion 7 is longer than above-described length L2 of first hole 2H, and thus, such heat dissipating portion 7 also has the exposed surface exposed to the first air path or the second air path. Therefore, such heat dissipating portion 7 can effectively dissipate the heat transmitted from shaft 6, as compared with the above-described conventional bush made of a metal.

Fourth Embodiment

<Configuration of Electric Vacuum Cleaner>

Figure 11:
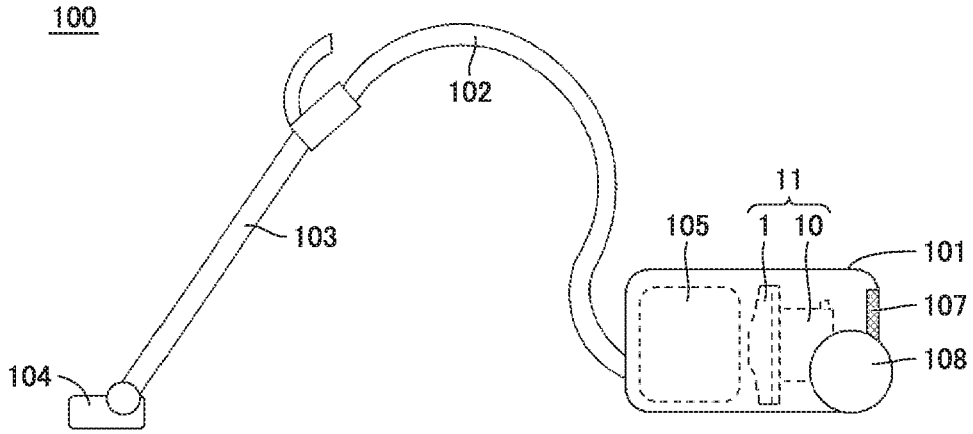
FIG. 11 is a schematic view showing an electric vacuum cleaner according to a fourth embodiment.

An electric vacuum cleaner 100 according to a fourth embodiment will be described with reference to FIG. 11. Electric vacuum cleaner 100 includes at least one of the electric blowers according to the first to third embodiments. Electric vacuum cleaner 100 includes, for example, an electric vacuum cleaner main body 101, a suction tool 104, a dust collecting portion 105, and electric blower 11 described above. An exhaust port 107 is provided in electric vacuum cleaner main body 101. Suction tool 104 is joined to electric vacuum cleaner main body 101 using a hose 102 and an extension pipe 103 serving as a pipe line to suck air in a portion to be cleaned. Hose 102 is connected to electric vacuum cleaner main body 101. Extension pipe 103 is connected to a tip side of hose 102. Suction tool 104 is connected to a tip portion of extension pipe 103.

Dust collecting portion 105 is provided inside electric vacuum cleaner main body 101, is in communication with suction tool 104, and stores dust in the sucked air. Electric blower 11 is provided inside electric vacuum cleaner main body 101 to suck the air from suction tool 104 into dust collecting portion 105. Electric blower 11 is the electric blower in accordance with the embodiment of the present invention described above. Exhaust port 107 is provided at the back of electric vacuum cleaner main body 101 to exhaust the air subjected to dust collection by dust collecting portion 105 out of electric vacuum cleaner main body 101.

At the sides of electric vacuum cleaner main body 101, rear wheels 108 are placed backward in a traveling direction.

At a lower portion of electric vacuum cleaner main body 101, a front wheel (not shown) is provided forward in the traveling direction.

<Operation of Electric Vacuum Cleaner>

Next, the operation of the electric vacuum cleaner will be described with reference to FIG. 11. In the electric vacuum cleaner configured as described above, shaft 6 (see FIG. 1) is rotated when electric power is supplied to electric motor portion 10 of electric blower 11. As shown in FIG. 1, by the rotation of shaft 6, centrifugal impeller 2 fixed to shaft 6 is rotated to suck air through suction port 3*c*. Thereby, the air on a surface to be cleaned is sucked into electric vacuum cleaner main body 101 through hose 102, extension pipe 103, and suction tool 104 joined to electric vacuum cleaner main body 101 shown in FIG. 11. The air sucked into electric vacuum cleaner main body 101 is subjected to dust collection in dust collecting portion 105.

Then, the air exhausted from dust collecting portion 105 is sucked through suction port 3*c* of electric blower 11 as shown in FIG. 1. The air sucked into electric blower 11 is pressurized and accelerated by centrifugal impeller 2, and is directed radially outward while swirling. Most of the air discharged from centrifugal impeller 2 is decelerated and pressurized between the plurality of stator vanes 5. Thereafter, the air is exhausted through discharge port 3*d* to the outside of electric blower 11. Then, the air is exhausted through exhaust port 107 provided in vacuum cleaner main body 101 shown in FIG. 11 to the outside of electric vacuum cleaner main body 101.

<Function and Effect of Electric Vacuum Cleaner>

Since above-described electric blower 11 is used in above-described electric vacuum cleaner 100, electric vacuum cleaner 100 can effectively dissipate the heat transmitted from the motor to shaft 6, and thus, a long-life electric vacuum cleaner can be obtained.

Electric vacuum cleaner 100 may include the electric blower according to the second or third embodiment. With such a configuration as well, electric vacuum cleaner 100 can effectively dissipate the heat transmitted from the motor to shaft 6. As a result, the occurrence of an abnormality by the heat is suppressed in electric vacuum cleaner 100 and electric vacuum cleaner 100 achieves a long life.

Although a canister-type electric vacuum cleaner in which hose 102 and extension pipe 103 are joined to electric vacuum cleaner main body 101 has been described as electric vacuum cleaner 100, electric vacuum cleaner 100 may be other types of electric vacuum cleaners. For example, the electric blower according to any one of the first to third embodiments described above is also applicable to a cordless-type electric vacuum cleaner or a stick-type electric vacuum cleaner in which an extension pipe is connected to an electric vacuum cleaner main body.

Fifth Embodiment

<Configuration of Hand Dryer>

Figure 12:
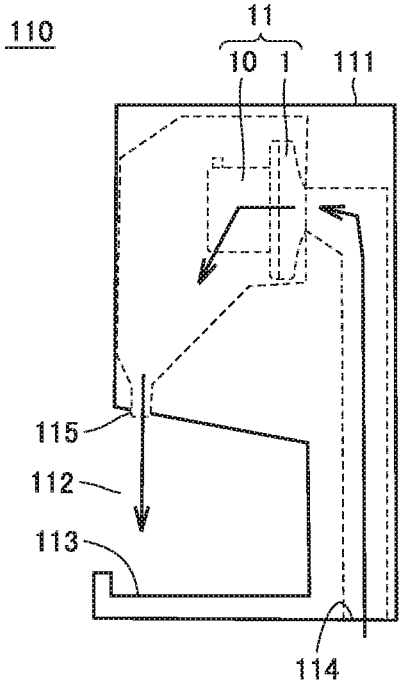
FIG. 12 is a schematic view showing a hand dryer according to a fifth embodiment.

Next, a hand dryer 110 according to a fifth embodiment will be described with reference to FIG. 12. Hand dryer 110 includes at least one of the electric blowers according to the first to third embodiments. Hand dryer 110 includes, for example, electric blower 11, a casing 111 serving as a main body, a hand insertion portion 112, a water receiving portion 113, an air inlet 114, and a nozzle 115. The hand dryer has electric blower 11 inside casing 111. In the hand dryer, hands are inserted into hand insertion portion 112 above water receiving portion 113, and water is blown off from the hands by air blown by electric blower 11. The blown-off water is stored into a drain receptacle (not shown) through water receiving portion 113.

Casing 111 constituting an outer shell of the hand dryer has a hand insertion opening in a front surface. Casing 111 includes hand insertion portion 112 as a process space adjacent to the hand insertion opening. A user can insert hands into hand insertion portion 112. Hand insertion portion 112 is formed in a lower portion of the front surface of casing 111, as a recess in the shape of an open sink in which a front surface and both side surfaces are opened. Water receiving portion 113 is located to form a lower portion of hand insertion portion 112. In an upper portion of hand insertion portion 112, nozzle 115 for blowing high-speed air downward toward hand insertion portion 112 is provided. Air inlet 114 is provided in a lower surface of casing 111.

Electric blower 11 is arranged inside an internal space of casing 111. Electric blower 11 is driven, for example, by electric power supplied from outside, or by electric power from a power supply such as a battery located inside casing 111. In addition, inside the space, there are provided an intake air path establishing communication between an intake air side of electric blower 11 and air inlets 114 provided in side surfaces of casing 111, and an exhaust air path establishing communication between an exhaust air side of electric blower 11 and nozzle 115.

In the exhaust air path, in the vicinity of an upstream side of nozzle 115, a heater for heating the air exhausted from electric blower 11 to produce warm air may be provided. In addition, inside casing 111, at a position closer to the back surface side than nozzle 115 serving as an air outlet, there may be provided a circuit substrate including a hand detection sensor and an illumination LED. The hand detection sensor detects the presence or absence of hands in hand insertion portion 112. When it is detected that hands are inserted in hand insertion portion 112, the illumination LED serving as illumination means brightly illuminates hand insertion portion 112.

<Operation of Hand Dryer>

Next, operation of the hand dryer when it is used to dry hands will be described. When a power switch of an electrical apparatus serving as the hand dryer is turned on, a control circuit and the like located inside casing 111 are energized, and the hand dryer enters an available state in which the hand dryer can dry hands (hereinafter referred to as a standby state). Then, when the user inserts wet hands to close to wrists through the hand insertion opening into hand insertion portion 112, insertion of the hands is detected by the hand detection sensor. As a result, the electric blower is actuated by the control circuit.

When electric blower 11 is actuated, air outside the hand dryer is sucked through air inlets 114. The air sucked through air inlets 114 is sucked into a suction side of electric blower 11. Electric blower 11 converts the air sucked from the intake air side into high-pressure air and exhausts it from the exhaust air side. The exhausted high-pressure air passes through the exhaust air path and reaches nozzle 115, and is converted into a high-speed air flow having a high kinetic energy. The high-speed air flow is blown downward from nozzle 115 into hand insertion portion 112. The high-speed air flow blown from nozzle 115 impinges on the wet hands inserted in hand insertion portion 112, and removes and blows off moisture on the hands from surfaces of the hands. Thereby, the hands can be dried. It should be noted that, when a heater switch (not shown) provided inside casing 111 is turned on, the heater is energized, and the high-pressure air passing through the exhaust air path is heated. Thus, warm air is blown from the nozzle, and thereby the user can use the hand dryer with a comfortable feeling even during the winter season and the like.

When the user removes the hands from hand insertion portion 112 after the hand drying process is finished, the hand detection sensor detects the removal of the hands, and the electric blower stops. Water droplets blown off from the hands are stored in water receiving portion 113 having a forwardly inclined structure.

<Function and Effect of Hand Dryer>

Since above-described electric blower 11 is used in above-described hand dryer 110, hand dryer 110 can effectively dissipate the heat transmitted from the motor to shaft 6, and thus, a long-life hand dryer can be obtained.

Hand dryer 110 may include the electric blower according to the second or third embodiment. With such a configuration as well, hand dryer 110 can effectively dissipate the heat transmitted from the motor to shaft 6. As a result, the occurrence of an abnormality by the heat is suppressed in hand dryer 110 and hand dryer 110 achieves a long life.

Although the embodiments of the present invention have been explained as described above, it is also possible to modify the embodiments described above in a various manner. In addition, the scope of the present invention is not limited to the embodiments described above. The scope of the present invention is defined by the scope of the claims, and is intended to include any modifications within the scope and meaning equivalent to the scope of the claims.

INDUSTRIAL APPLICABILITY

The present invention is advantageously applicable to apparatuses using a centrifugal electric blower, such as a home or industrial electric vacuum cleaner and a hand dryer.

The invention claimed is:

1. An electric blower comprising:

an electric motor portion including a rotation shaft;

a centrifugal impeller formed to surround at least a part of the rotation shaft; and a heat dissipating portion connecting the centrifugal impeller and the rotation shaft, the centrifugal impeller including a boss portion connected to the heat dissipating portion, and a plurality of rotor vanes connected to the boss portion, the boss portion being provided with a first hole extending along an extending direction of the rotation shaft, the heat dissipating portion including a first portion connected to an inner circumferential surface of the first hole, and at least one second portion connected to the first portion in the extending direction and located outside the first hole, a material for the heat dissipating portion having a thermal conductivity higher than that of a material for the centrifugal impeller, a length of the heat dissipating portion in the extending direction being longer than a length of the first hole in the extending direction, the electric blower comprising a fixing member fixed to a portion of the shaft located on a suction side of the at least one second portion.

2. The electric blower according to claim 1, wherein the at least one second portion is formed on a suction side of the electric blower with respect to the first hole.

3. The electric blower according to claim 2, wherein a maximum value of a width of the second portion in a radial direction perpendicular to the extending direction is not more than a minimum value of a width of the boss portion in the radial direction perpendicular to the extending direction.

4. The electric blower according to claim 1, wherein the at least one second portion is formed on a side opposite to the suction side of the electric blower with respect to the first hole.

5. The electric blower according to claim 1, wherein the maximum value of the width of the second portion in the radial direction perpendicular to the extending direction is larger than a maximum value of a width of the first portion in the radial direction perpendicular to the extending direction.

6. The electric blower according to claim 1, wherein the material for the heat dissipating portion is a metal, and the material for the centrifugal impeller is a resin.

7. The electric blower according to claim 1, wherein the width of the first portion in the radial direction perpendicular to the extending direction varies in a rotation direction of the centrifugal impeller.

8. An electric vacuum cleaner comprising:

an electric vacuum cleaner main body;

a suction tool coupled to the electric vacuum cleaner main body by a pipe line and configured to suck air in a portion to be cleaned;

a dust collecting portion provided inside the electric vacuum cleaner main body, being in communication with the suction tool, and configured to store dust in the sucked air; and the electric blower as recited in claim 1 provided inside the electric vacuum cleaner main body and configured to suck the air from the suction tool into the dust collecting portion, an exhaust port through which the air subjected to dust collection by the dust collecting portion is exhausted out of the electric vacuum cleaner main body being provided on an outer side of the electric vacuum cleaner main body.

9. A hand dryer comprising:

a main body including a hand insertion portion that is an opening into which a user inserts hands; and the electric blower as recited in claim 1 provided inside the main body, the main body being provided with an air inlet through which the electric blower takes in outside air, and an air outlet through which the outside air supplied from the electric blower is blown toward the hand insertion portion.

10. The electric blower according to claim 1, wherein the first portion and the at least second portion are integrally formed.

* * * * *